US008304674B2

(12) United States Patent
Regantini et al.

(10) Patent No.: US 8,304,674 B2
(45) Date of Patent: Nov. 6, 2012

(54) SIGNALING DEVICE FOR CIRCUIT BREAKER AND ELECTRICAL APPARATUS COMPRISING THE SIGNALING DEVICE

(75) Inventors: Annunzio Regantini, Bergamo (IT); Stefano Mussetti, Bergamo (IT)

(73) Assignee: ABB Technology AG, Zurich (CH)

( * ) Notice: Subject to any disclaimer, the term of this patent is extended or adjusted under 35 U.S.C. 154(b) by 231 days.

(21) Appl. No.: 12/774,288

(22) Filed: May 5, 2010

(65) Prior Publication Data

US 2010/0282583 A1 Nov. 11, 2010

(30) Foreign Application Priority Data

May 6, 2009 (EP) ..... 09159564

(51) Int. Cl.
*H01H 3/00* (2006.01)

(52) U.S. Cl. ..... 200/329

(58) Field of Classification Search ..... 200/331, 200/329, 401, 400, 303, 307, 308, 330
See application file for complete search history.

(56) References Cited

U.S. PATENT DOCUMENTS

| | | | | |
|---|---|---|---|---|
| 4,794,356 | A | 12/1988 | Yu et al. | |
| 5,823,323 | A * | 10/1998 | Seymour et al. | 200/308 |
| 6,040,746 | A * | 3/2000 | Maloney et al. | 335/13 |

FOREIGN PATENT DOCUMENTS

| | | | |
|---|---|---|---|
| EP | 1684320 | | 7/2006 |
| EP | 09159564 | | 9/2009 |
| JP | 06139903 | | 5/1994 |
| JP | 06139904 | A | 5/1994 |
| WO | 01/16984 | A | 3/2001 |

* cited by examiner

*Primary Examiner* — Edwin A. Leon
(74) *Attorney, Agent, or Firm* — Paul R. Katterle; Melissa J. Szczepanik

(57) ABSTRACT

A signaling device having an electrical switch configured to generate an electrical signal indicating a transition of an associated circuit breaker from a first state to a second state. A movable body is pivotally mounted around a first axis (101) so as to interact with the actuating mechanism. A return spring is operatively connected to the pivoting body (3) and is mounted around an axis substantially parallel to said first axis.

14 Claims, 5 Drawing Sheets

200

SIGNALING DEVICE FOR CIRCUIT BREAKER AND ELECTRICAL APPARATUS COMPRISING THE SIGNALING DEVICE

CROSS-REFERENCE TO RELATED APPLICATION

This application claims priority under 35 U.S.C. §119(a)-(d) to European Patent Application Serial Number 09159564.5, filed on May 6, 2010, the entire contents of which are hereby incorporated by reference.

BACKGROUND OF THE INVENTION

The present invention relates to the field of the signaling devices to be connected to circuit beakers, or other electrical switches, in order to provide an electrical signal indicating a state transition performed by the circuit breaker.

Signaling devices which provide electrical signals indicating that a circuit breaker is switched from one state to another are known also by the term "transient contacts".

With particular reference to the medium voltage field, a traditional signaling device comprises a body which moves under the action of a kinematic mechanism of the circuit breaker. During this movement, the body interacts with and thereby actuates an actuating mechanism of a micro-switch. The micro-switch is configured to provide an electrical signal indicating the transition performed by the circuit breaker. This known signaling device is conceived in order to have a long lifecycle and perform several thousands operation.

Although known signaling devices perform in a rather satisfying way, there is still room and desire for further improving such devices, in particular as regard to their lifecycle.

SUMMARY OF THE INVENTION

According to an embodiment of the invention, there is provided a signaling device, suitable to be operatively coupled to a circuit breaker, which comprises: an electrical switch configured to generate an electrical signal indicating a transition of the circuit breaker from a first state to a second state; an actuating mechanism for actuating the electrical switch; a movable body which is pivotally mounted around a first axis so as to interact with the actuating mechanism; and a return spring which is operatively connected to the pivoting body and is mounted around an axis substantially parallel to said first axis.

In accordance with a preferred embodiment, the return spring and the pivoting body are mounted coaxially around the same axis.

Preferably, the return spring is a torsion coil spring.

BRIEF DESCRIPTION OF THE DRAWINGS

Further characteristics and advantages will be more apparent from the following description of a preferred embodiment and of its alternatives given as a way of an example with reference to the attached drawings in which.

DETAILED DESCRIPTION OF ILLUSTRATIVE EMBODIMENTS

Figure 1:
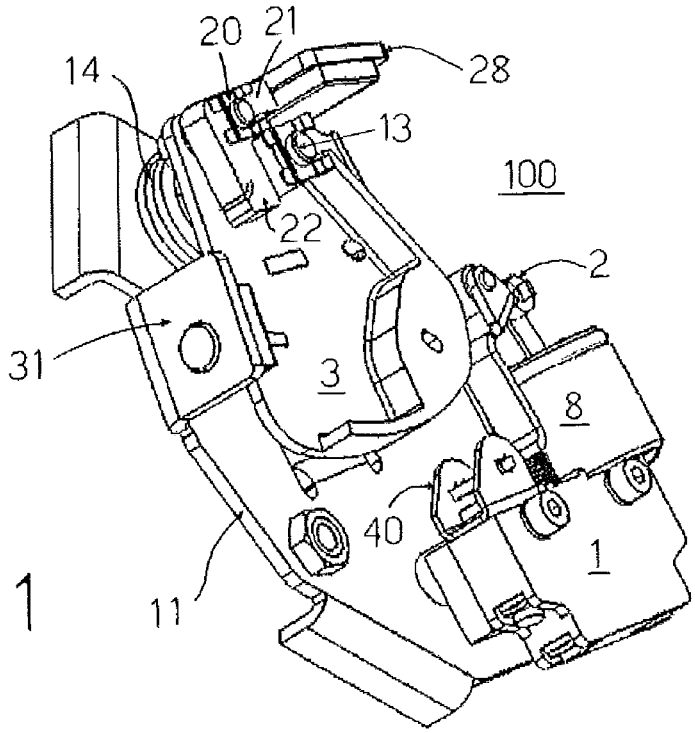
FIG. 1 shows a perspective view of a signaling device comprising a pivoting body in a rest position, in accordance with an embodiment of the invention.

An embodiment of a signaling device 100 suitable to be operatively connected to an associated circuit breaker (e.g. of the medium voltage type) is shown in the FIGS. 1-5. The signaling device 100 can provide an electrical signal indicating that the circuit breaker to which is associated is switched from a first state to a second state and, particularly, from the closed position wherein the movable and fixed contacts of the circuit breaker are electrically coupled to each other, to the open state wherein the movable contacts of the circuit breaker are separated from the corresponding fixed contacts. This type of signaling devices indicating a transition performed by the circuit breaker can be also referred to as a "transient contact".

The signaling device 100 comprises an electrical switch 1, an actuating mechanism 2 for actuating the electrical switch 1, a movable body 3 (hereinafter "pivoting body") which is pivotally mounted around a first axis 101 so as to interact with the actuating mechanism 2; and a return spring 14 which is operatively connected to the pivoting body 3 and is mounted around a second axis substantially parallel to the first axis 101.

According to a preferred embodiment, the first axis 101 and the second axis substantially coincide, i.e. the return spring 14 is mounted coaxially with the pivoting body 3 around the first axis 101.

Preferably, the return spring 14 is a torsion spring, more preferably a torsion coil spring as shown in the figures.

Further, the signaling device 100 preferably comprises a transmission mechanism 4 suitable to be operatively coupled to the circuit breaker.

Particularly, the above mentioned elements are mounted on and supported by a base 11 made for example of metallic material, such as steel.

The electrical switch 1 is for example a known micro-switch, particularly a low voltage switch, provided with a movable contact and a fixed contact (not shown); such a switch 1 is well known to the skilled man and therefore will not be described in detail hereinafter.

The actuating mechanism 2 shown in the figures comprises a shaped lever 5, e.g. an S-shaped lever which is operatively connected to the movable contact of the micro-switch 1. In the example illustrated, the lever 5 has a first end arm 6 pivotally connected to a connection element 40 rigidly fixed to an enclosure of the electrical switch 1; moreover, a tension spring 12 acts on the first end arm 6. A second end arm 7 of the S-shaped lever 5 is connected to a piston such as, for example, a pneumatic piston 8 which is suitable to dampen the pushing action of the lever 5.

The actuating mechanism 2 further includes a roller or rotating sleeve 9, which is mounted on the second end arm 7 so as to be contacted by a lateral edge 10 of the pivoting body 3. The lateral edge 10 can push the rotating sleeve 9 so as to cause a movement of the lever 5 which is transferred to the piston 8 and the spring 12 and thus causes the actuation of the switch 1.

The pivoting body 3, which is preferably cam shaped, is pivotally mounted so at to rotate about the first axis 101; in particular, the pivoting body 3 is articulated around a first pivot 13 which is transversely, e.g. perpendicularly, connected to the base 11. The pivoting body 3 is pivotally connected to the pivot 13 by means of a block element such as, for example, a first clip 17. Moreover, the first pivot 13 is rotatable housed inside a hollow element 27 (FIG. 5), such as a sleeve, rigidly connected to the base 11.

It is observed that the pivoting body 3 can move between two different operative configurations. In a first configuration, the pivoting body 3 stays in a rest position (as shown in FIG. 1 and in FIG. 2) in which it does not interact with the actuating mechanism 2 of the micro-switch 1. In a second configuration, the pivoting body 3 performs a movement. Indeed, the pivoting body 3 firstly rotates (e.g. in an anticlockwise direction indicated by the arrow F1 in FIG. 2) so as to push the rotating sleeve 9 of the actuating mechanism 2 and arrive up to a second position (hereinafter "final position") shown in FIG. 5. Secondly, the pivoting body 3 rotates in an opposite direction (i.e. clockwise direction corresponding to the arrow F2) so as to move from the final position (FIG. 5) and assume again the rest position (FIG. 1).

As it will result more clearly from the following description, the rotation of the pivoting body 3 from the rest position to the final position is caused by the action of the kinematic mechanism of the circuit breaker. In particular, as it will be described in more details hereinafter, the kinematic mechanism can act on the transmission mechanism 4 which in turns transmits the movement to the pivoting body 3; or in alternative, the kinematic mechanism of the circuit breaker could act directly on the pivoting body 3.

Preferably, the circuit breaker causes the rotation of the pivoting body 3 towards the final position when the circuit breaker switches from the closed state to the open state. In accordance with an example, the opposite transition, i.e. from the open state to the closed state does not substantially produce any rotation of the pivoting body 3.

The first return spring 14 is arranged and operatively coupled to the pivoting body 3 in such a way that when the pivoting body 3 rotates from the rest position towards the final position the first return spring 14 is subject to a mechanical moment (i.e. a moment of force), preferably a torque, which causes a preloading of the first return spring 14.

As above mentioned, the first torsion coil spring 14 (also shown in FIG. 6) is preferably mounted coaxially with the pivoting body 3; in particular, the spring 14 is arranged around the first pivot 13 and is provided with a first end 15 operatively connected to the base 11 and a second end 16 operatively connected to the pivoting body 3. As an example, throughout the rotation of the pivoting body 3 from the rest position to the final position the first coil spring is subject to a mechanical moment that causes a rotation of the second end 16 producing a preloading compression of the first torsion coil spring 14. When the pivoting body 3 reaches the final position (FIG. 5) the first torsion coil spring 14, by releasing the energy accumulated during its loading compression, act on and biases the pivoting body 3 thus causing the rotation of the pivoting body 3 from the final position to the rest position.

According to a particular example regarding the medium voltage field, the first torsion coil spring 14 may comprise 2.5-5 turns (e.g. 3.4 turns), has an internal diameter D1 of 15-25 mm (e.g. 20 mm) and a theoretical spring constant of about 2600-4000 Nmm/° (e.g. 3640 Nmm/°). The coil wire diameter ranges, for instance, between 1.5 and 3 mm (e.g. 2 mm). The first torsion coil spring 14 in made of any suitable metallic material, such as, for example AISI 302 or 304 stainless steel.

Reference is now made to the transmission mechanism 4 which allows transmitting the movement of the kinematic mechanism of the circuit breaker to the pivoting body 3. According to the example shown, the transmission mechanism 4 includes a pivoting lever 18 and a second pivot 19 around which the pivoting lever 18 can rotate. In particular, the second pivot 19 is bolted to the pivoting body 3 and extends transversely, e.g. perpendicularly, to such body.

The exemplary pivoting lever 18 shown in the figures is L-shaped and its vertex is provided with a hole for the passing through of the second pivot 19 to which is pivotally fixed by means of a second clip 20 (FIG. 1).

A first arm 21 of the pivoting lever 18 is arranged in such a way to allow a contact with a portion of the kinematic mechanism of the circuit breaker. A second arm 22 of the pivoting lever 18 abuts against a pushing element of the pivoting body 3. As an example, such pushing element is the above mentioned hollow body 27.

Figure 5:
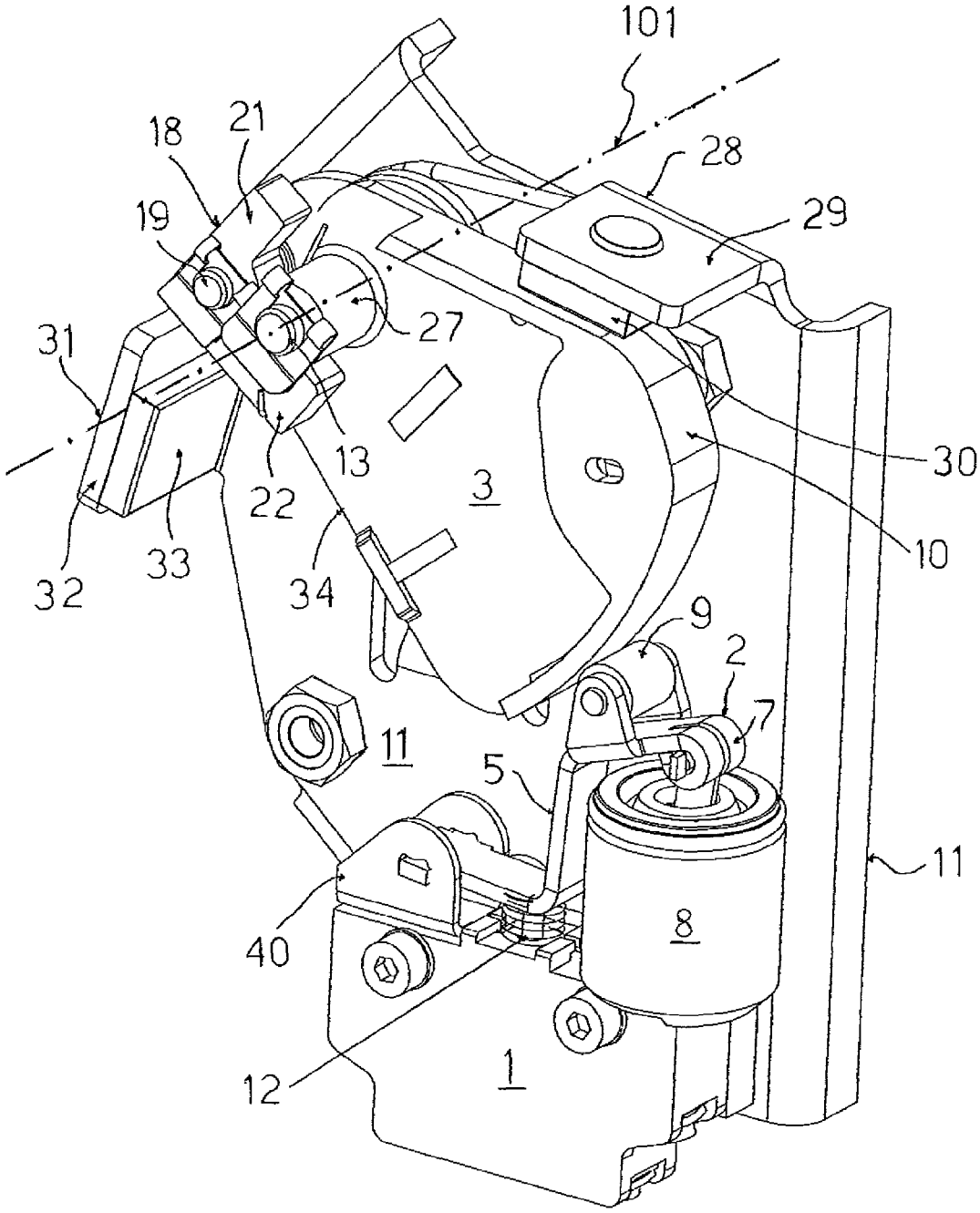
FIG. 5 shows a perspective view of said signaling device wherein the pivoting body is in a pivoting configuration.
Figure 6:
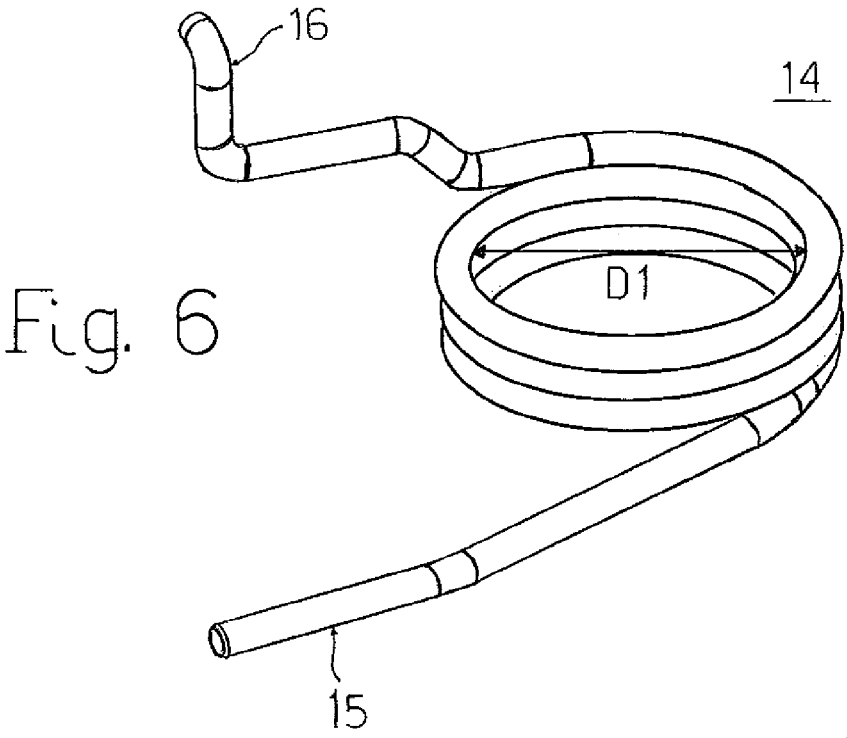
FIG. 6 shows a perspective view of a first torsion coil spring to be connected to said pivoting body.

When the first arm 21 of the pivoting lever 18 is pushed by the kinematic mechanism of the circuit breaker, the second arm 22 acts on the hollow body 27 and transmits a rotation movement to the pivoting body 3. In this situation, the pivoting lever 18 rotates in an anticlockwise direction pushing the pivoting body 3 and so producing its rotation from the rest position to the final position (FIG. 5). When the pivoting body 3 returns back to the rest position from the final position it pushes the pivoting lever 18 which rotates in a clockwise direction and returns back in the position shown in FIG. 1 and FIG. 2.

Advantageously, the transmission mechanism 4 also includes a second return spring 24 (FIG. 3 and FIG. 7) acting on the pivoting lever 18 to rotate the latter between an intermediate position assumed under the action of the portion of the circuit breaker and an operative position to be assumed when the pivoting body 3 is in the rest position.

According to an example, this second return spring 24 acts when the pivoting body 3 is in the rest position and the circuit breaker switches from the above mentioned open state to the closed state. In this transition the kinematic mechanism of the circuit breaker engages the first arm 21 of the pivoting lever 18 producing a clockwise rotation of the latter which does not involve the pivoting body 3. The second return spring 24 is arranged so as to rotate the pivoting lever 18 in anticlockwise direction in order to bring such lever in the operative position shown in FIG. 1.

The second return spring 24 can be any type of spring suitable to bring again the pivoting lever 18 in the position in which it engages the hollow element 27 of the pivoting body 3. Preferably, the second return spring 24 is similar to the first return spring 14 and therefore is arranged in such a way that when the pivoting lever 18 rotates from the operative position towards the intermediate position the second return spring 24 is subject to a moment of force which causes a preloading of such spring 24.

Figure 7:
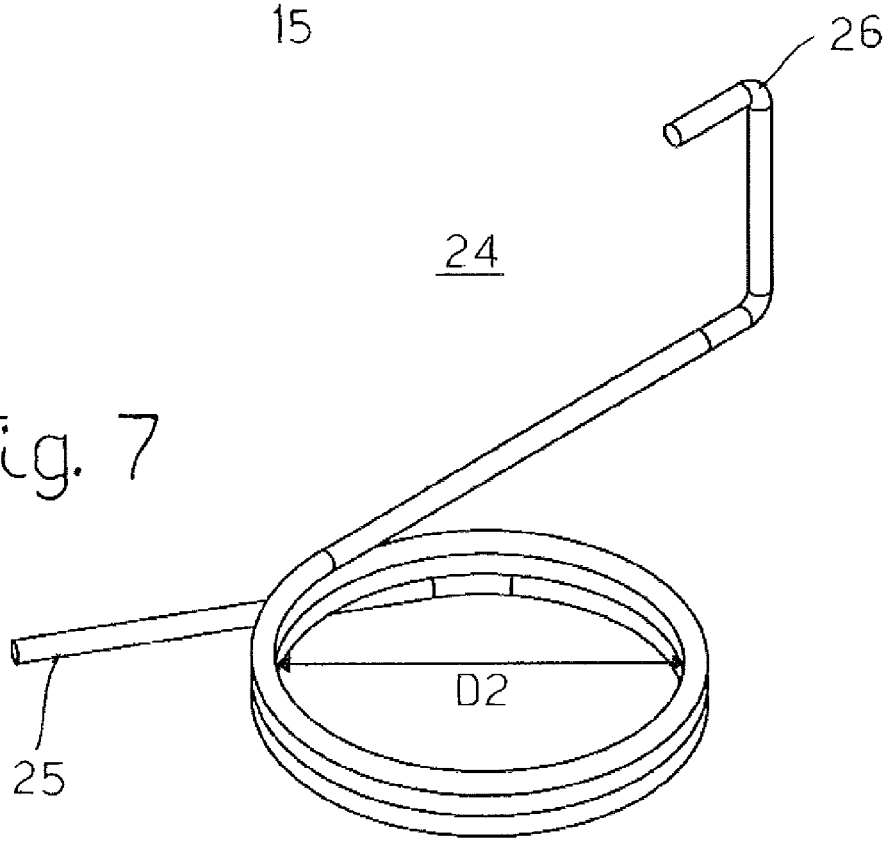
FIG. 7 shows a perspective view of a second torsion coil spring to be connected to a pivoting lever.

Particularly, said moment of force can be a flexure moment or a torque. Accordingly, the second return spring 24 can be a flexure spring (e.g. a cantilever spring or a leaf spring) or, more preferably, a torsion spring, as the one shown in the figures. Advantageously, the second torsion spring 24 shown in FIG. 7 is a torsion coil spring.

The second torsion coil spring 24 is arranged around the second pivot 19 and is provided with a respective first end 25 operatively connected to the pivoting body 3 and a second end 26 operatively connected with the pivoting lever 18. As an example, throughout the rotation (in clockwise direction) of the pivoting lever 18 due to the switching of the circuit breaker from the open state to the closed state, the second coil spring 24 is submitted to a moment of force that causes a preloading compression of the second coil spring 24. Then the preloaded second coil spring 24 acts so as to bias the pivoting lever 18 and produce its return rotation (anticlockwise direction) to reach the operative position.

In accordance with a particular example, the second torsion coil spring 24 includes about 2-3.5 turns (e.g. 2.8 turns), has an internal diameter D2 of 8-12 mm (e.g. 10.4 mm) and a theoretical spring constant of 1.8-2.2 Nmm/° (e.g. 0.2 Nmm/°). The coil wire diameter ranges, for instance, between 0.4 and 0.8 mm (e.g. 0.6 mm).

Alternatively, the second return spring can be a tension spring (not shown) having an end connected to the second arm 22 of the pivoting lever 18 and another end connected to a pin element (not shown) fixed to the base 11.

Moreover, the signaling device 100 comprises a first stop abutment 28 placed so as to stop the stroke of the pivoting body 3 at the final position (FIG. 5). Particularly, the stop abutment 28 comprises a supporting wall 29 provided with a first shock absorber 30. The supporting wall 29 can be a plate rigidly fixed to the base 11. Preferably, the supporting wall 29 is made in one piece with the base 11, as an example, using a molding manufacturing process.

The shock absorber 30 can be, for instance, a rubber element fixed, e.g. by means of glue, to an internal surface of the supporting wall 29 so as to be hit by the lateral edge 10 of the pivoting body 3 when it rotates in the anticlockwise direction.

According to a particular embodiment, the signaling device 100 is also provided with a second stop abutment 31 (FIG. 1 and FIG. 5) placed to stop the pivoting body 3 at the rest position. The second stop abutment 31 can be analogous to the first stop abutment 28 and includes a further supporting wall 32 and a further shock absorber 33. The further shock absorber 33 is placed so as to be hit by another side wall 34 of the pivoting body 3, opposite to the side wall 10.

Figure 8:
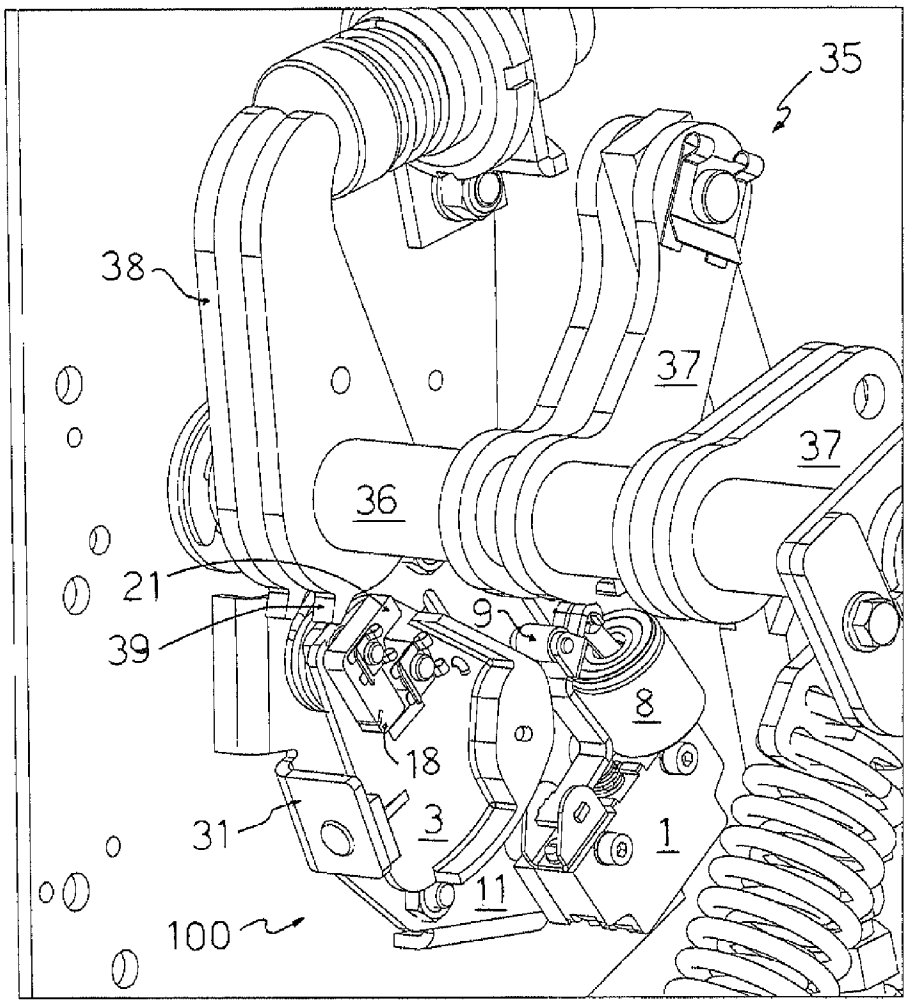
FIG. 8 shows a portion of an electrical apparatus comprising said signaling device and a circuit breaker.

FIG. 8 shows a portion of an electrical apparatus 200 comprising a circuit breaker provided with a kinematic mechanism 35 and the above described signaling device 100. The kinematic mechanism 35 is well known to a man skilled in the art and includes a shaft 36 connected to cranks 37 and to an activating cam element 38 provided with a tooth 39. The tooth 39 is arranged to engage the first arm 21 of the pivoting lever 18.

It has to be observed that FIG. 8 depicts the particular situation in which the circuit breaker is already switched from the closed state (i.e. corresponding to the closing of an associated electric circuit) to the open state (i.e. corresponding to the opening of the electric circuit) and the tooth 39 is on the left side with respect the pivoting lever 18, as visible in FIG. 8.

Figure 2:
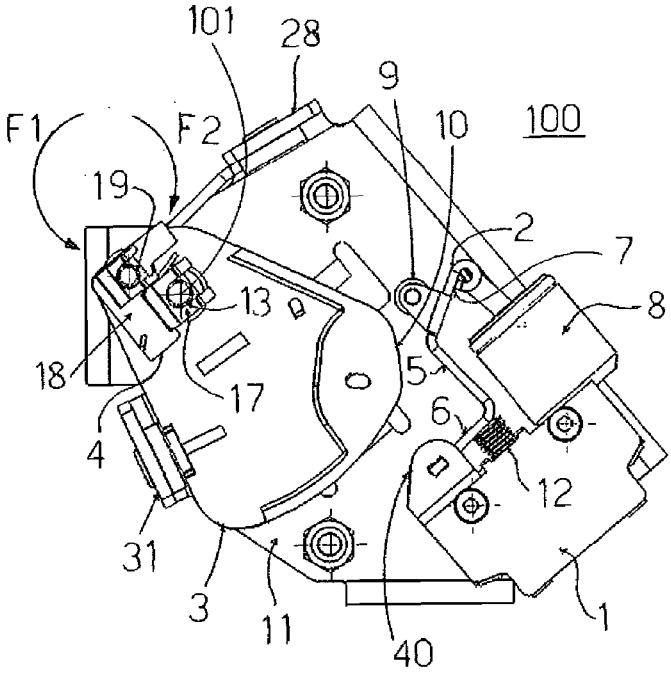
FIG. 2 shows a front view of said signaling device.
Figure 3:
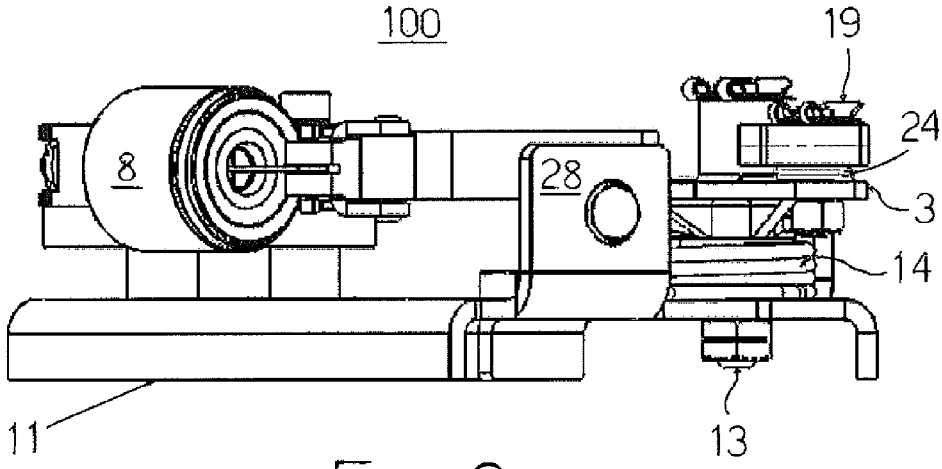
FIG. 3 shows a lateral view of said signaling device.
Figure 4:
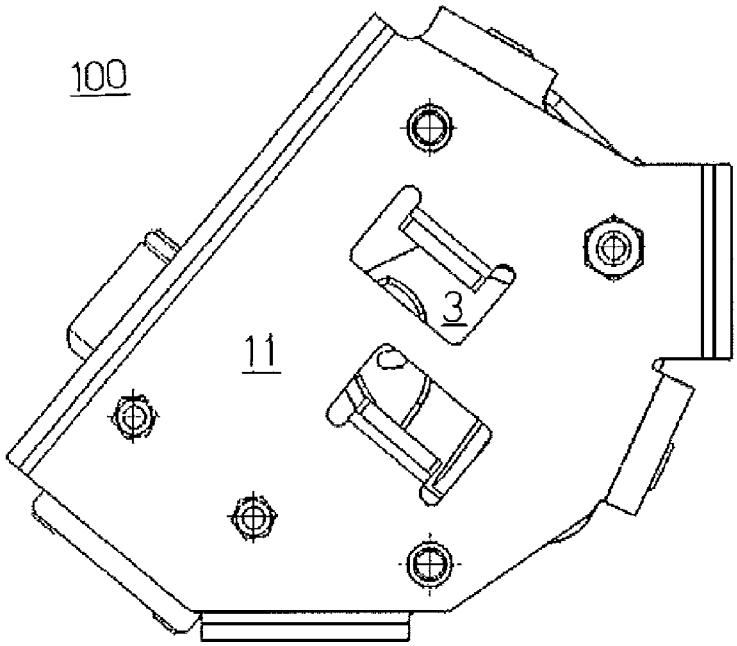
FIG. 4 shows a rear view of said signaling device.

The operation of the apparatus 200 will be hereinafter described starting from a situation in which the circuit breaker is in the closed state and (contrary to the situation shown FIG. 8) the tooth 39 in placed at the right side of the pivoting lever 18. In this case, the pivoting body 3 is in the rest position and the pivoting lever 18 is in the operative position (FIG. 1 and FIG. 2).

Starting from this situation the circuit breaker switches (e.g. due to a fault) towards the open state and the cam element 38 rotates in a clockwise direction to cause the tooth 39 pushes the first arm 21 of the pivoting lever 18. The second arm 22 of the pivoting lever 18 acts on the hollow element 27 of the pivoting body 3 which rotates in an anticlockwise direction. It has to be observed that the cam element 38 of the circuit breaker gives a relevant kinetic energy to the pivoting body 3.

The pivoting body 3 engages the element 9 producing a closing switching of the micro-switch 1 that provides an electrical signal, e.g. to a control unit, indicating that a transition of the circuit breaker towards the open state has occurred. The first torsion coil spring 14 is loaded thanks to this anticlockwise rotation of the pivoting body 3.

During its stroke, the pivoting body 3 is then stopped in the final position by the first stop abutment 28 which is realized so as to absorb the high energy hit produced by the pivoting body 3 and to reduce any mechanical stress for both the pivoting body 3 and the whole structure of the signaling device 100.

The first torsion coil spring 14 releases the loaded elastic energy and causes the pivoting body 3, together with the pivoting lever 18, to rotate clockwise and return back from the second position to the rest position (situation illustrated in FIG. 8). Hence, the second or final position is a movement reverse position for the pivoting body 3.

It is noticed that by using a spring of the type which undergoes a moment of force, such as the torsion coil spring 14, it is possible to reduce mechanical stress for the spring and so to increase the spring life by ensuring a fast return of the pivoting body in the rest position.

The pivoting body 3 is then stopped in the rest position by the second stop abutment 31 that contributes to reduce any mechanical stress for both the pivoting body 3 and the whole structure of the signaling device 100.

When the circuit breaker performs the opposite switching operation (i.e. from the open position to the closed position) the tooth 39 acts on the first arm 21 of the pivoting lever 18. The pivoting lever 18 rotates in a clockwise direction leaving the operative position and reaching the intermediate position. This rotation caused by the tooth 39 loads the second torsion coil 24 which consequently releases the corresponding elastic energy by drawing back the pivoting lever 18 in the operative position.

It is clear from the above that the signaling device 100 of the present invention offers some improvements over signaling devices of known type having the same functionalities. In particular, the purposive structure devised and the use of the first and second torsion coil springs 14 and 24, allow having a reduced mechanical stress and an overall increased lifecycle of the device itself.

The signaling device thus conceived may undergo numerous modifications and come in several variants, all falling within the scope of the inventive concept as defined by the appended claims; for example, the various components of the actuating mechanism, or of the transmission mechanism may be differently shaped or may be constituted by a different number of parts, the pivoting body 3 can be differently shaped, et cetera. The component materials and dimensions of the device may be of any type, according to needs and the state of the art.

The invention claimed is:

1. A signaling device suitable to be operatively coupled to a circuit breaker, comprising:

an electrical switch configured to generate an electrical signal indicating a transition of the circuit breaker from a first state to a second state;

an actuating mechanism for actuating the electrical switch;

a movable body which is pivotally mounted around a first axis so as to interact with the actuating mechanism; and a return spring which is mounted around an axis substantially parallel to said first axis, said return spring operatively connected to said pivoting body which is adapted for assuming a rest position and a pivoting configuration in which said pivoting body rotates to interact with said actuating mechanism, reaches a final position and returns back to said rest position, and wherein said return spring is operatively connected to said pivoting body in such a way that when said pivoting body rotates towards said final position said return spring is subject to a moment of force causing its preloading, said return spring then biasing said pivoting body from said final position to said rest position.

2. The signaling device according to claim 1, wherein said return spring is mounted coaxially with said pivoting body around said first axis.

3. The signaling device according to claim 1, wherein said return spring is a torsion coil spring.

4. The signaling device according to claim 3, further including:

a base supporting at least the pivoting body and the return spring;

a first pivot fixed on said base transversely to a pivoting plane of the pivoting body; and wherein the torsion coil spring is arranged around said first pivot and the pivoting body is pivotally connected to said first pivot.

5. The signaling device according to claim 4, wherein said torsion coil spring is provided with a first end interacting with the base and a second end interacting with the pivoting body so that the movement from the rest position to the final position causes a loading of the torsion spring.

6. The signaling device according to claim 1, further comprising a stop abutment placed to stop the pivoting body at the final position.

7. The signaling device according to claim 6, wherein said stop abutment comprises a supporting wall provided with a first shock absorber to contact a first lateral wall of the pivoting body.

8. The signaling device according to claim 1, further including a transmission mechanism suitable to operatively interact with the circuit breaker in order to cause a rotation of the pivoting body corresponding to said transition of the circuit breaker from the first state to the second state.

9. The signaling device according to claim 8, wherein the transmission mechanism comprises:

a pivoting lever provided with a first arm to be pushed by a portion of the circuit breaker, and a second arm to abut against an activating push element of the pivoting body to cause said pivoting configuration;

a further pivot fixed on said pivoting body around which the pivoting lever can rotate; and a further return spring acting on the pivoting lever to rotate the pivoting lever between an intermediate position assumed under the action of the portion of the circuit breaker and an operative position to be assumed when the pivoting body is in the rest position.

10. The signaling device according to claim 9, wherein said further return spring is arranged in such a way that when the pivoting lever rotates from the operative position to the intermediate position said further return spring is subject to a moment of force.

11. The signaling device according to claim 10, wherein said further return spring is a further torsion coil spring mounted around the further pivot and having a corresponding end acting on said pivoting lever.

12. The signaling device according to claim 11, further comprising a second stop abutment placed to stop the pivoting body at the rest position, said second stop abutment comprising a further supporting wall provided with a second shock absorber positioned to contact a second lateral wall of the pivoting body.

13. The signaling device according to claim 1, wherein said pivoting body is cam shaped.

14. Electrical apparatus comprising:

a circuit breaker provided with a kinematic mechanism;

a signaling device operatively coupled to said kinematic mechanism to generate at least an electrical signal indicating that the circuit breaker has performed a transition from a first state to a second state, wherein said signaling device comprises:

an electrical switch configured to generate an electrical signal indicating a transition of the circuit breaker from a first state to a second state;

an actuating mechanism for actuating the electrical switch;

a movable body which is pivotally mounted around a first axis so as to interact with the actuating mechanism, said pivoting body moveable from a rest position to a final position through the action of said kinematic mechanism; and a return spring which is operatively connected to the pivoting body and is mounted around an axis substantially parallel to said first axis.

* * * * *